US005875916A

United States Patent [19]

Crockett, Sr. et al.

[11] Patent Number: 5,875,916

[45] Date of Patent: Mar. 2, 1999

[54] PROTECTIVE STORAGE HOUSING

[76] Inventors: Larry Crockett, Sr.; Delores Crockett, both of 40 Meadow Lake Dr., Downingtown, Pa. 19335

[21] Appl. No.: 970,015

[22] Filed: Nov. 13, 1997

[51] Int. Cl.[6] ..... B65D 45/16; B65D 81/00

[52] U.S. Cl. ..... 220/324; 220/327; 220/806; 220/62.22; 220/902; 206/523; 206/811

[58] Field of Search ..... 220/324, 326, 220/327, 378, 592.25, 592.27, 62.22, 902, 614, 626, 806, 803, 804, 802, 801; 206/521, 523, 524, 811

[56] References Cited

U.S. PATENT DOCUMENTS

| | | | |
|---|---|---|---|
| D. 343,715 | 1/1994 | DeGrezia et al. . | |
| D. 345,862 | 4/1994 | Skubensky et al. . | |
| 2,552,641 | 5/1951 | Morrison | 206/523 X |
| 3,317,072 | 5/1967 | Zavertnik et al. | 220/378 X |
| 3,401,671 | 9/1968 | Axelrod et al. | 220/592.25 X |
| 3,416,692 | 12/1968 | Cline et al. | 220/902 X |
| 3,865,323 | 2/1975 | Stronge et al. . | |
| 4,082,200 | 4/1978 | Guest el al. . | |
| 4,091,852 | 5/1978 | Jordan et al. . | |
| 4,838,418 | 6/1989 | Teixeira . | |
| 4,903,493 | 2/1990 | Van Iperen et al. | 206/523 X |

FOREIGN PATENT DOCUMENTS

| | | | |
|---|---|---|---|
| 2086353 | 5/1982 | United Kingdom | 206/523 |

*Primary Examiner*—Stephen K. Cronin
*Assistant Examiner*—Nathan Newhouse

[57] ABSTRACT

A waterproof container is provided including a housing formed of an elastomeric material defining an interior space with an open top having a planar top peripheral edge. An interior lining of the housing is constructed from a foam material. The lining is situated within the interior space of the housing for protecting the contents thereof. Further provided is a cover having a planar rectangular configuration with a top face, a bottom face, and a periphery formed therebetween. The bottom face of the cover has a cut out with a rectangular cross-section formed adjacent the entire periphery. The cut out has a width equal to a thickness of the faces of the housing. The cover further has a planar bottom lining constructed from a foam material situated on the bottom face of the cover. Next provided is a gasket having a planar rectangular configuration and a width equal to the thickness of the faces of the housing. A coupling mechanism is included for selectively securing the cover to the housing. During use, the cover is situated over the open top of the housing with the top peripheral edge of the housing situated within the cut out of the cover with the gasket positioned therebetween. The coupling mechanism functions to maintain the cover fixed to the housing to preclude water from entering the interior space of the housing.

6 Claims, 2 Drawing Sheets

PROTECTIVE STORAGE HOUSING

BACKGROUND OF THE INVENTION

1. Field of the Invention

The present invention relates to storage chests and more particularly pertains to a new protective storage housing for storing and protecting valuables during hurricanes, tornadoes, and other acts of god.

2. Description of the Prior Art

The use of storage chests is known in the prior art. More specifically, storage chests heretofore devised and utilized are known to consist basically of familiar, expected and obvious structural configurations, notwithstanding the myriad of designs encompassed by the crowded prior art which have been developed for the fulfillment of countless objectives and requirements.

Known prior art storage chests include U.S. Pat. No. 4,838,418; U.S. Pat. No. 3,865,323; U.S. Pat. Des. 343,715; U.S. Pat. Des. 345,862; U.S. Pat. No. 4,091,852; and U.S. Pat. No. 4,082,200.

In these respects, the protective storage housing according to the present invention substantially departs from the conventional concepts and designs of the prior art, and in so doing provides an apparatus primarily developed for the purpose of storing and protecting valuables during hurricanes, tornadoes, and other acts of god.

SUMMARY OF THE INVENTION

In view of the foregoing disadvantages inherent in the known types of storage chests now present in the prior art, the present invention provides a new protective storage housing construction wherein the same can be utilized for storing and protecting valuables during hurricanes, tornadoes, and other acts of god.

The general purpose of the present invention, which will be described subsequently in greater detail, is to provide a new protective storage housing apparatus and method which has many of the advantages of the storage chests mentioned heretofore and many novel features that result in a new protective storage housing which is not anticipated, rendered obvious, suggested, or even implied by any of the prior art storage chests, either alone or in any combination thereof.

To attain this, the present invention generally comprises a housing formed of an elastomeric material. As shown in the Figures, the housing has a rectilinear configuration with a rectangular planar bottom face having a periphery defined by a pair of parallel long edges and a pair of parallel short edges formed therebetween. A pair of rectangular planar side faces is integrally coupled to the bottom face along the parallel long edges thereof and in perpendicular relationship therewith. Associated therewith is a pair of square planar end faces integrally coupled to the bottom face along the parallel short edges thereof and in perpendicular relationship therewith. By this structure, an interior space is defined with an open top having a planar top peripheral edge. As shown in FIG. 7, a plurality of spaced vertically oriented apertures are formed in the top peripheral edge with a plurality of threaded grooves formed therein. With attention now to FIGS. 4–6, an interior lining constructed from a foam material is shown. The lining is situated within the interior space of the housing and has a constant thickness. The lining covers an entire portion of an inner surface of the faces of the housing with the exception of a portion of the inner surface of the faces adjacent the top peripheral edge of the housing. Next provided is a cover having a planar rectangular configuration with a top face, a bottom face, and a periphery formed therebetween. The bottom face of the cover has a cut out with a rectangular cross-section formed adjacent the entire periphery. Such cut out is designed with a width equal to a thickness of the faces of the housing. The cover further has a plurality of spaced vertically oriented apertures formed therein adjacent to the periphery. The apertures of the cover reside in communication with the cut out of the housing. A planar bottom lining constructed from a foam material is situated on the bottom face of the cover. As best shown in FIG. 5, the lining is spaced from an inner periphery of the cut out by a predetermined distance equal to a thickness of the interior lining. As shown in FIG. 2, a gasket is provided including a planar rectangular configuration and a width equal to the thickness of the faces of the housing. A plurality of bolts are included each with a hexagonal head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new protective storage housing apparatus and method which has many of the advantages of the storage chests mentioned heretofore and many novel features that result in a new protective storage housing which is not anticipated, rendered obvious, suggested, or even implied by any of the prior art storage chests, either alone or in any combination thereof.

It is another object of the present invention to provide a new protective storage housing which may be easily and efficiently manufactured and marketed.

It is a further object of the present invention to provide a new protective storage housing which is of a durable and reliable construction.

An even further object of the present invention is to provide a new protective storage housing which is susceptible of a low cost of manufacture with regard to both materials and labor, and which accordingly is then susceptible of low prices of sale to the consuming public, thereby making such protective storage housing economically available to the buying public.

Still yet another object of the present invention is to provide a new protective storage housing which provides in the apparatuses and methods of the prior art some of the advantages thereof, while simultaneously overcoming some of the disadvantages normally associated therewith.

Still another object of the present invention is to provide a new protective storage housing for storing and protecting valuables during hurricanes, tornadoes, and other acts of god.

Even still another object of the present invention is to provide a new protective storage housing that includes a housing formed of an elastomeric material defining an interior space with an open top having a planar top peripheral edge. An interior lining of the housing is constructed from a foam material. The lining is situated within the interior space of the housing for protecting the contents thereof. Further provided is a cover having a planar rectangular configuration with a top face, a bottom face, and a periphery formed therebetween. The bottom face of the cover has a cut out with a rectangular cross-section formed adjacent the entire periphery. The cut out has a width equal to a thickness of the faces of the housing. The cover further has a planar bottom lining constructed from a foam material situated on the bottom face of the cover. Next provided is a gasket having a planar rectangular configuration and a width equal to the thickness of the faces of the housing. A coupling mechanism is included for selectively securing the cover to the housing. During use, the cover is situated over the open top of the housing with the top peripheral edge of the housing situated within the cut out of the cover with the gasket positioned therebetween. The coupling mechanism functions to maintain the cover fixed to the housing to preclude water from entering the interior space of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
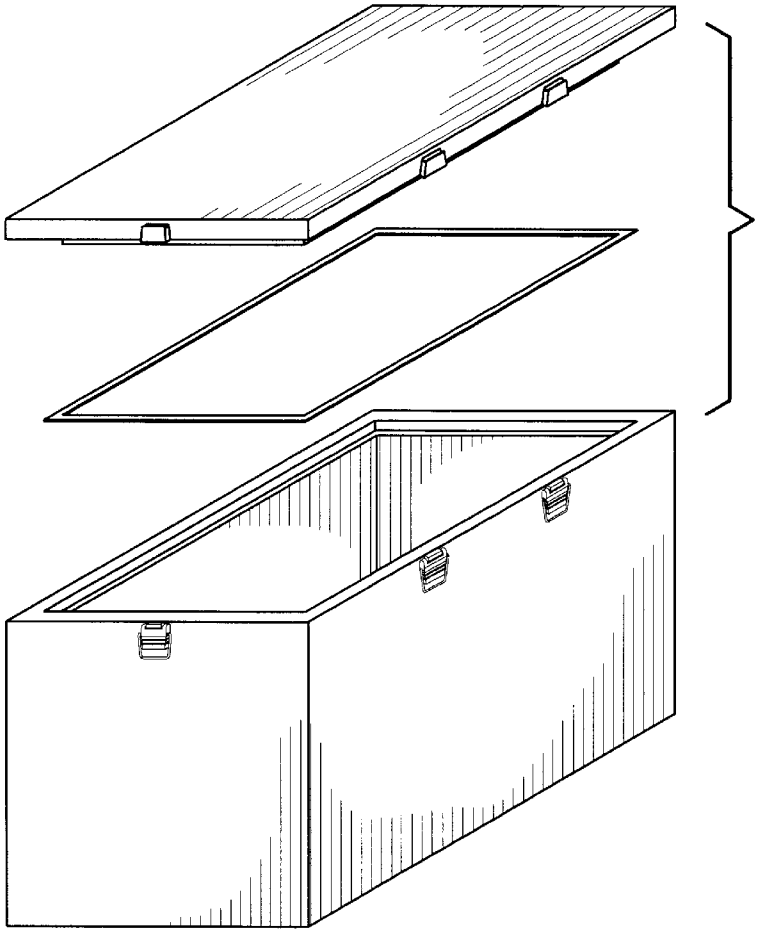
FIG. 2 is an exploded perspective view of the present invention.
Figure 1:
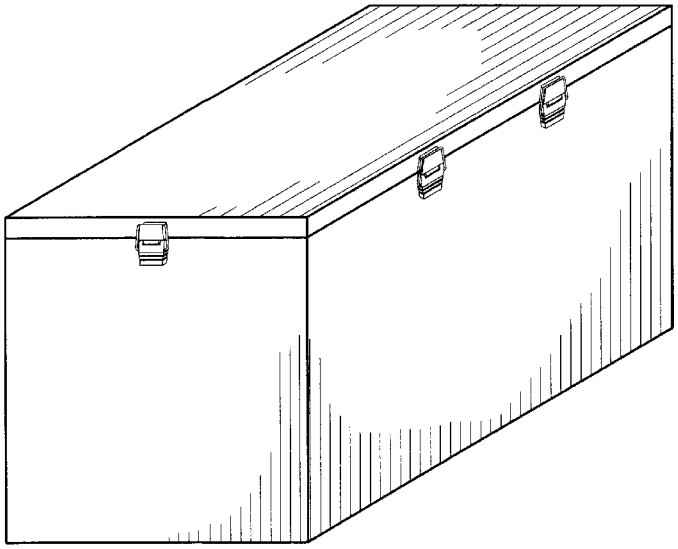
FIG. 1 is a perspective view of a new protective storage housing according to the present invention.
Figure 3:
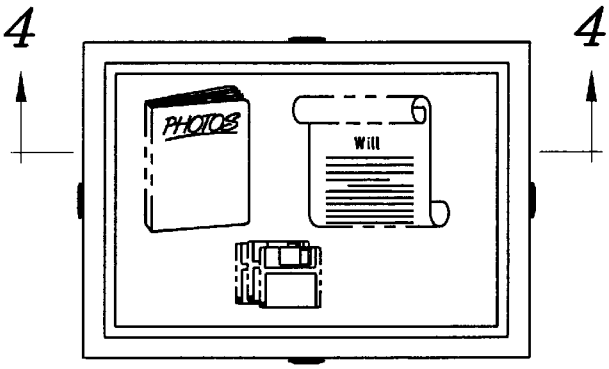
FIG. 3 is a top view of the present invention.

With reference now to the drawings, and in particular to FIGS. 1 through 7 thereof, a new protective storage housing embodying the principles and concepts of the present invention and generally designated by the reference numeral 10 will be described.

The present invention includes a housing 12 formed of an elastomeric material. As shown in the Figures, the housing has a rectilinear configuration with a rectangular planar bottom face 14 having a periphery defined by a pair of parallel long edges and a pair of parallel short edges formed therebetween. A pair of rectangular planar side faces 16 is integrally coupled to the bottom face along the parallel long edges thereof and in perpendicular relationship therewith. Associated therewith is a pair of square planar end faces 18 integrally coupled to the bottom face along the parallel short edges thereof and in perpendicular relationship therewith. By this structure, an interior space is defined with an open top having a planar top peripheral edge 20. The size of the housing and the thickness of the faces are preferably such that the housing floats when submersed in water.

Figure 7:
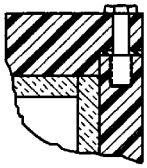
FIG. 7 is a cross-sectional sectional view of the embodiment shown in FIG. 6.

As shown in FIG. 7, a plurality of spaced vertically oriented apertures 22 are formed in the top peripheral edge with a plurality of threaded grooves formed therein. As an option, such apertures may be lined with a rigid metal for reasons that will become apparent hereinafter.

Figure 5:
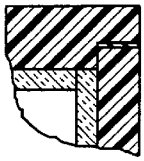
FIG. 5 is a cross-sectional view of the present invention.
Figure 4:
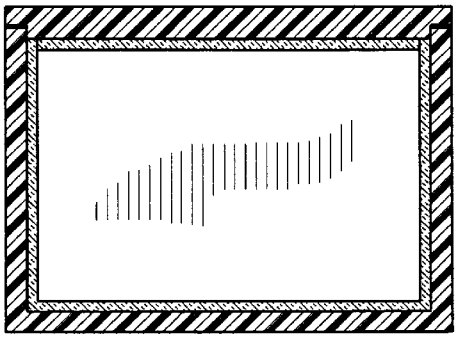
FIG. 4 is a cross-sectional view of the present invention taken along line 4—4 shown in FIG. 3.
Figure 6:
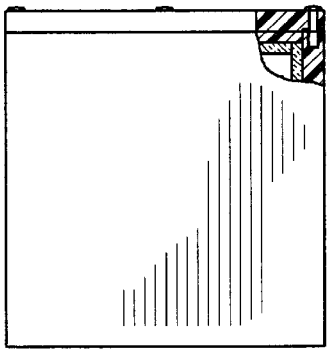
FIG. 6 is a side view of an alternate embodiment of the present invention.

With attention now to FIGS. 4–6, an interior lining 24 constructed from a foam material is shown. The lining is situated within the interior space of the housing and has a constant thickness. Such thickness is preferably at least ½ that of the faces of the housing. The lining covers an entire portion of an inner surface of the faces of the housing with the exception of a portion 26 of the inner surface of the faces adjacent the top peripheral edge of the housing.

Next provided is a cover 27 having a planar rectangular configuration with a top face, a bottom face, and a periphery formed therebetween. The bottom face of the cover has a cut out 28 with a rectangular cross-section formed adjacent the entire periphery. Such cut out is designed with a width equal to a thickness of the faces of the housing. The cover further has a plurality of spaced vertically oriented apertures 30 formed therein adjacent to the periphery. The apertures of the cover reside in communication with the cut out of the housing. A planar bottom lining 32 constructed from a foam material is situated on the bottom face of the cover. As best shown in FIG. 5, the lining is spaced from an inner periphery of the cut out by a predetermined distance equal to a thickness of the interior lining.

As shown in FIG. 2, a gasket 34 is provided including a planar rectangular configuration and a width equal to the thickness of the faces of the housing. A plurality of bolts 36 are included each with a hexagonal head.

During use, the cover is situated over the open top of the housing. In such position, the top peripheral edge of the housing is situated within the cut out of the cover with the gasket positioned therebetween. As such, the apertures of the cover and the housing are in alignment such that the bolts may secured therein to preclude water from entering the interior space of the housing. Also when the cover is situated on the housing, the interior lining of the housing and the bottom lining of the cover abut to form a complete box for safely storing articles of value therein. It should be understood that the principles employed to construct the present invention may be utilized in association with other forms of storage. In an alternate embodiment, a plurality of clamps 38 are used in combination with tabs 40 to effect the sealing of the cover to housing. Note FIGS. 1 & 2.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A waterproof container comprising, in combination:

a housing formed of an elastomeric material having a rectilinear configuration with a rectangular planar bottom face having a periphery defined by a pair of parallel long edges and a pair of parallel short edges formed therebetween, a pair of rectangular planar side faces integrally coupled to the bottom face along the parallel long edges thereof and in perpendicular relationship therewith, and a pair of square planar end faces integrally coupled to the bottom face along the parallel short edges thereof and in perpendicular relationship therewith, thereby defining an interior space with an open top having a planar top peripheral edge;

a plurality of spaced vertically oriented apertures formed in the top peripheral edge with a plurality of threaded grooves formed therein;

an interior lining constructed from a foam material, the lining situated within the interior space of the housing and having a constant thickness, the lining covers an entire portion of an inner surface of the faces of the housing with the exception of a portion of the inner surface of the faces adjacent the top peripheral edge of the housing;

a cover having a planar rectangular configuration with a top face, a bottom face, and a periphery, the bottom face having a cut out with a rectangular cross-section formed adjacent the entire periphery with a width equal to a thickness of the faces of the housing, the cover further having a plurality of spaced vertically oriented apertures formed therein adjacent to the periphery and in communication with the cut out of the cover and a planar bottom lining constructed from a foam material situated on the bottom face of the cover and spaced from an inner periphery of the cut out by a predetermined distance equal to a thickness of the interior lining;

a gasket having a planar rectangular configuration and a width equal to the thickness of the faces of the housing; and a plurality of bolts each with a hexagonal head;

whereby the cover is situated over the open top of the housing with the top peripheral edge of the housing situated within the cut out of the cover with the gasket positioned therebetween such that the apertures of the cover and the housing are in alignment such that the bolts may be secured therein to preclude water from entering the interior space of the housing.

2. A waterproof container comprising:

a housing formed of an elastomeric material having a bottom face and a plurality of side faces extending upwardly therefrom defining an interior space with an open top having a planar top peripheral edge, along the side;

an interior lining constructed from a foam material, the lining situated within the interior space of the housing;

a cover having a top face, a bottom face, and a periphery, the bottom face having a cut out formed adjacent the entire periphery with a width equal to a thickness of the side faces of the housing, the cover further having a planar bottom lining constructed from a foam material situated on the bottom face of the cover;

a gasket having a width equal to the thickness of the side faces of the housing; and coupling means for selectively securing the cover to the housing;

whereby the cover is situated over the open top of the housing with the top peripheral edge of the housing situated within the cut out of the cover with the gasket positioned therebetween such that the coupling means maintains the cover fixed to the housing to preclude water from entering the interior space of the housing.

3. A waterproof container as set forth in claim 2 wherein the housing has a rectilinear configuration with said bottom face having a periphery defined by a pair of parallel long edges and a pair of parallel short edges formed therebetween.

4. A waterproof container as set forth in claim 2 wherein the coupling means comprises a plurality of clamps situated on housing.

5. A waterproof container as set forth in claim 2 wherein the coupling means comprises a plurality of spaced vertically oriented apertures formed in the top peripheral edge with a plurality of threaded grooves formed therein, a plurality of apertures formed in the cover, and a plurality of bolts.

6. A waterproof container as set forth in claim 2 wherein the interior lining and bottom lining have a constant thickness, wherein the interior lining covers an entire portion of an inner surface of the housing.

* * * * *